United States Patent [19]

McIlwain et al.

[11] Patent Number: 4,493,297

[45] Date of Patent: Jan. 15, 1985

[54] PLASMA JET IGNITION DEVICE

[75] Inventors: Michael E. McIlwain, Franklin; Jonathan F. Grant, Wayland; Zsolt Golenko, North Reading, all of Mass.; Alan D. Wittstein, Fairfield, Conn.

[73] Assignee: Geo-Centers, Inc., Newton Upper Falls, Mass.

[21] Appl. No.: 424,856

[22] Filed: Sep. 27, 1982

[51] Int. Cl.[3] ..... F02P 3/08

[52] U.S. Cl. ..... 123/143 B; 219/267; 219/270

[58] Field of Search ..... 123/143 B, 143 R, 1 A; 361/264, 266; 219/267, 270

[56] References Cited

U.S. PATENT DOCUMENTS

| | | | |
|---|---|---|---|
| 2,503,472 | 4/1950 | Chilowsky | 123/143 |
| 4,092,967 | 6/1978 | Haslett | 123/143 B |

FOREIGN PATENT DOCUMENTS

| | | | |
|---|---|---|---|
| 964539 | 3/1975 | Canada | 123/143 B |
| 133995 | 12/1951 | Sweden | 123/143 B |

*Primary Examiner*—Raymond A. Nelli

*Attorney, Agent, or Firm*—Wolf, Greenfield & Sacks

[57] ABSTRACT

An ignition device of the plasma jet type is disclosed. The device has a cylindrical cavity formed in insulating material with an electrode at one end. The other end of the cylindrical cavity is closed by a metal plate with a small orifice in the center which plate serves as a second electrode. An arc jumping between the first electrode and the orifice plate causes the formation of a highly-ionized plasma in the cavity which is ejected through the orifice into the engine cylinder area to ignite the main fuel mixture.

Two improvements are disclosed to enhance the operation of the device and the length of the plasma plume. One improvement is a metal hydride ring which is inserted in the cavity next to the first electrode. During operation, the high temperature in the cavity and the highly excited nature of the plasma breaks down the metal hydride, liberating hydrogen which acts as an additional fuel to help plasma formation.

A second improvement consists of a cavity insert containing a plurality of spaced, metal rings. The rings act as secondary spark gap electrodes reducing the voltage needed to maintain the initial arc in the cavity.

15 Claims, 3 Drawing Figures

PLASMA JET IGNITION DEVICE

U.S. GOVERNMENT RIGHTS IN THE INVENTION

The United States has certain rights in this invention arising from contract DE-AC01-80ER1063 between the United States Department of Energy and Geo-Centers, Inc.

FIELD OF THE INVENTION

This invention relates to ignition devices, such as spark plugs and the like, and, more particularly to plasma jet ignition devices.

BACKGROUND OF THE INVENTION

Many modern day internal combustion engines are designed to run with fuel/air mixtures that are both economical and non-polluting. Recently, in order to meet emission standards fuel/air ratios have become leaner resulting in reduced pollution but sometimes also resulting in degraded engine performance.

One of the problems with the so-called "lean burn" engines is that the low fuel/air ratio is difficult to properly ignite. The standard two electrode spark plug with its small gap is a very inefficient ignitor for the lean ratios because the effective ignition surface is only the highly ionized area of the spark itself, which is quite small.

Various arrangements have been devised to overcome the poor ignition characteristics of lean fuel/air mixtures. One of these arrangements involves using a small pre-ignition chamber in which a much higher fuel-to-air ratio is introduced to obtain initial ignition, the flame front then spreads from the pre-ignition chamber into the main cylinder area where it ignites the main fuel/air mixture.

Other attempts have been made to change the characteristics of the spark plug or ignitor mechanism itself. One of the most successful variations of the normal spark plug arrangement is known as a plasma jet ignitor. An ignitor of this type is shown in U.S. Pat. Nos. 3,906,919 and 3,842,819 and usually consists of an insulator and housing similar to an ordinary two-electrode plug. However, a cavity is formed in the alumina insulating material at the end where the usual spark gap is located. At one end of the cavity a central electrode is located. The other end of the cavity is closed by a metal plate having a small orifice located near the center of the cavity. When the plasma jet ignitor is used with a standard reciprocating piston engine during the compression cycle, a small amount of the fuel/air mixture is forced through the orifice into the cavity formed in the insulating material. At the proper time, a high voltage is applied to the central electrode causing an arc to form between the central electrode and the orifice plate. This arc initiates formation of a highly ionized plasma in the cavity which, due to the expansion of the plasma, spews forth from the orifice into the main cylinder area causing a large plume. The plume has sufficient area to ignite the main fuel/air mixture even in the case of lean mixtures.

Although the plasma jet ignitor is superior to the standard two electrode spark gap ignitor, it has several drawbacks. One of these is that, under normal operating conditions. Only a small amount of fuel is forced into the plasma cavity resulting in the small plume length in the main cylinder area. Attempts have been made to overcome this problem by introducing a small amount of liquid fuel into the plasma cavity through a secondary port passing through the insulating material of the spark plug. While the introduction of a small amount of liquid fuel does enhance the plasma plume length, there are practical problems in providing an access port through the spark plug insulating material. The presence of liquid fuel in the cavity area also produces dangerous vapors creating the danger of explosion.

Another problem with prior art plasma jet ignition devices is that a very high voltage is often needed to sustain the initial arc which starts plasma formation in the plasma cavity. Thus, the plasma jet ignition devices typically operate at two to three hundred times the voltage required to fire standard two-electrode gap spark plugs.

Accordingly, it is an object of the present invention to provide a plasma jet ignition device which has increased plume length over prior art spark plugs.

It is another object of the present invention to provide a plasma jet ignition device which is capable of firing with much lower voltages than prior art ignition devices.

It is a further object of the present invention to provide a source of solid fuel in the plasma cavity to enhance plasma plume length.

It is yet another object of the present invention to provide multiple spark gaps in the plasma cavity to reduce the firing voltage needed to operate the plasma jet ignition device.

SUMMARY OF THE INVENTION

The foregoing objects are achieved and the foregoing problems solved in one illustrative embodiment of the invention in which the prior art plasma jet ignition devices are improved by the addition of a metal hydride ring in the plasma cavity. During operation, the heat generated by the plasma and to the highly ionized state of the plasma causes the liberation of the hydrogen atoms from the metal hydride ring which hydrogen atoms act as fuel to produce an increased plasma plume length and combustion burning velocity in the engine cylinder area.

In addition, an insert is placed in the plasma cavity containing a number of spaced electrode rings which act as multiple spark gaps to reduce the operating voltage needed to maintain the initial arc in the plasma cavity.

DETAILED DESCRIPTION OF THE PREFERRED EMBODIMENT

Figure 1:
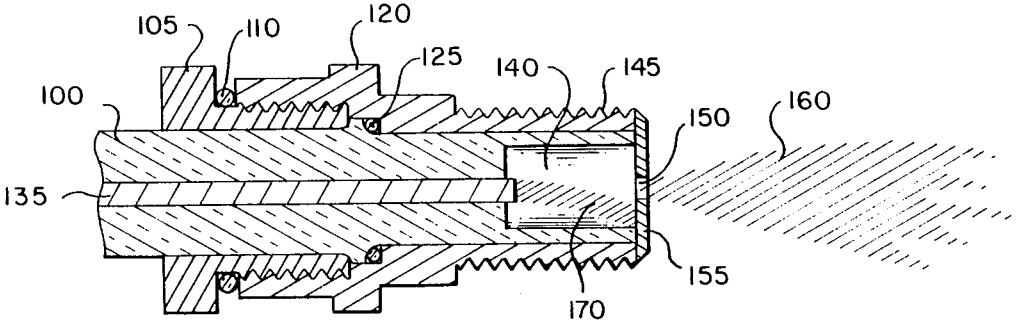
Fig. 1 PRIOR ART
FIG. 1 of the drawing shows a prior art plasma jet ignition device.

FIG. 1 shows a cross-sectional view of the cavity end of a prior art plasma jet ignition device. The device consists of a insulating material 100 which is typically alumina, porcelain or some other suitable insulating material, which has cavity 140 formed at one end. Typically, the cavity is cylindrical but may be forced in other shapes. Passing down the center of the insulator 100 is a central electrode 135 which may be a wire or rod, the end of which is located at one end of cavity 140 and forms one electrode for initiating the plasma discharge.

Insulator 100 is clamped in housing shell 120 by means of follower nut 105. O-ring seals 110 and 125 are provided to prevent any bypass of gas or vapors along the body of insulator 100.

The lower end of 145 housing 120 is threaded to allow the plasma jet ignition device to be screwed into the engine cylinder head.

Attached to the end of housing 120 by spot welding or other suitable means is an orifice plate 155 containing a small orifice 150. Plate 150 is electrically connected to housing 120 which serves as a ground. The walls of cavity 140 meet plate 150 complete the cylindrical cavity as shown in FIG. 1.

During the compression stroke of the associated engine, a small amount of fuel/air mixture is forced through orifice 150 into cavity 140. Thereafter, at an appropriate time, a conventional electrical ignition circuit places a high voltage on central electrode 135 which causes an arc 170 to form between the end of electrode 135 and orifice plate 150. This arc ionizes the fuel/air mixture in cavity 140 producing a highly energetic and ionized plasma. The plasma rapidly expands and sprays out of orifice 150 into a plume 160 which extends into the cylinder cavity igniting the main fuel/air mixture.

Figure 2:
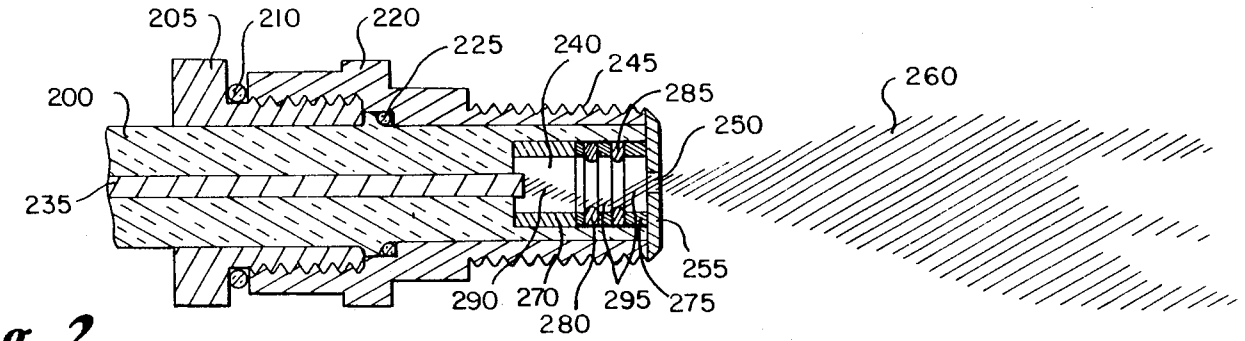
FIG. 2 shows an illustrative embodiment of a plasma jet ignition device containing both the metal hydride ring and multiple spark gap improvements of the present invention.

FIG. 2 shows a cross-sectional view of the cavity end of an illustrative improved plasma ignition device fashioned in accordance with the principles of the present invention. The improved plasma jet ignition device consists of a ceramic insulator 200 which is similar to that used in the prior art. Insulator 200 is clamped between housing 220 and follower nut 205.

Two ignition electrodes are formed by central electrode 235 and orifice plate 255 which also contains an orifice 250 as previously described.

However, according to the principles of the invention located in cavity 240 are metal hydride ring 270 and an insert 275 containing multiple gap rings 280 and 285.

In particular, hydride ring 270 consists of a hollow plug of sintered hydride material. Several metals may be used in the composition of this ring such as, barium, titanium, zirconium and lithium aluminum hydride, however, titanium hydride is the preferred material. As previously described, the energy released by the plasma discharge occurring in cavity 240 reacts with the walls of ring 270 releasing molecular hydrogen which acts to enhance the formation of the plasma in cavity 240. Many different shaped and sized rings or other configurations of the hydride material may be used. The normal "life" of the ignitor is dependent of the amount of hydride material incorporated in the configuration. It has been found that with a zirconium hydride ring about 0.25 inches in diameter and having walls of approximately 0.125 inches in thickness and a length of 0.25 inches there is sufficient hydride fuel material to enable the ignition device to be satisfactorily fired approximately ten million times. This is sufficient to allow extended use over a one year period with a normal internal combustion engine. The dimensions and shape of ring 270 may also be varied depending on the geometric structure of cavity 240.

Also provided in cavity 240 is a multiple gap ring arrangement 275. This arrangement contains multiple metallic rings 280 and 285 which may illustratively be formed of steel. The rings are electrically isolated from each other and from the walls of cavity 240 by means of an insulating material. It is critical that the insulating material be ablative so that it is continually eroded by reaction with the plasma in the cavity. Otherwise metal sputtered from the electrodes during plasma and arc formation would quickly plate over the insulating material and form a short-circuit across the electrodes. Materials which may illustratively be used as insulators include alumina, magnesium oxide and other suitable high temperature insulating materials. The insulating material at the entire outside of the ring arrangement is fused, sintered or covered with another suitable insulating material to prevent arcing between the rings. Multiple ring structure 275 is spaced from central electrode 235 by means of metal hydride ring 270. If a metal hydride ring is not used with the apparatus a suitable insulating material ring may replace hydride ring 270 to space the multiple gap arrangement away from electrode 235.

In operation, an arc jumps from central electrode 235 to ring 280 and from ring 280 in multiple arcs 295 to ring 285 and to orifice plate 255. Since the length of each of the multiple total arc is less than the single arc length without the multiple gap ring structure the voltage needed to sustain a plasma discharge to occur is considerably lower than in the prior art devices.

As with the prior art devices, the formation of a high energy plasma in cavity 240 results in the formation of a plasma plume 260 which projects into the engine cylinder space and ignites the main fuel/air mixture.

Figure 3:
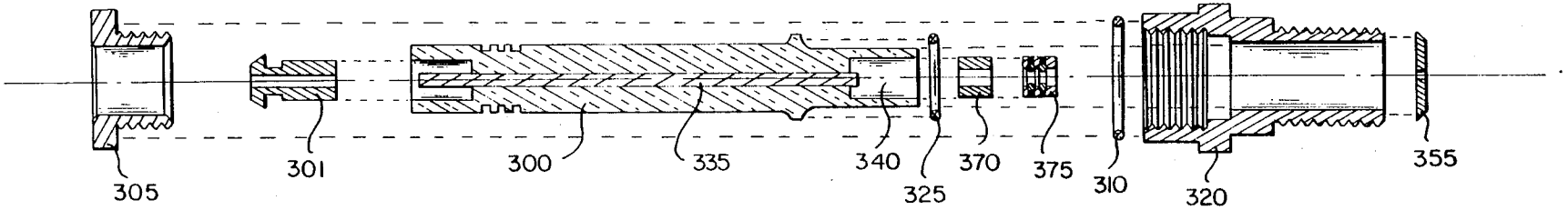
FIG. 3 of the invention shows an exploded diagram of the inventive plasma jet ignition device.

FIG. 3 of the drawing shows an exploded view of the entire illustrative ignitor. In particular, the plasma jet ignition device is assembled by inserting insulator 300 into shell structure 320 and screwing in follower nut 305. Alternatively, insulator 300 may be crimped into shell 320 in a conventional manner. After insulator 300 has been inserted into shell 320 a hydride ring 370 or an insulating spacer is inserted into cavity 340 followed by multiple gap ring structure 375. Finally, orifice plate 355 is spot welded into the end of housing 320 to complete the structure.

Alternatively, orifice plate 355 may be welded or attached to housing 320 and the hydride ring 370 and the multiple gap ring structure 375 inserted into housing 340 before insulator 300 is inserted into shell 320.

The end of electrode 335 is provided with a suitable nut 301 or other attaching device to allow a spark plug wire to be attached to the unit.

Although only one illustrative embodiment of the invention has been shown herein other modifications and changes will be apparent to those skilled in the art which modifications and changes are within the spirit and scope of the present invention and are intended to be covered by the claims herein.

What is claimed is:

1. In a plasma jet ignition device having an insulating material with a plasma cavity formed therein, a first electrode having an end inserted into said cavity, an orifice plate having an orifice therein comprising one side of said cavity and means for causing an arc discharge to occur within said cavity between said first electrode and said orifice plate, the improvement comprising, a solid fuel pellet inserted into said cavity, said pellet being responsive to said arc discharge for releasing a gaseous fuel into said cavity.

2. In a plasma jet ignition device, the improvement according to claim 1 wherein said pellet is formed of a metal hydride material.

3. In a plasma jet ignition device, the improvement according to claim 2 wherein said pellet is formed of titanium hydride.

4. In a plasma jet ignition device, the improvement according to claim 2 wherein said pellet is formed of zirconium hydride.

5. In a plasma jet ignition device according to claim 1 wherein said plasma cavity is cylindrically shaped and said first electrode is located at one end of said plasma cavity the improvement according to claim 1 wherein said pellet is ring-shaped and is located in said plasma cavity at said end towards first said electrode.

6. In a plasma jet ignition device, the improvement according to claim 5 wherein said ring-shaped solid fuel pellet has walls with a thickness of substantially 0.125 inches.

7. In a plasma jet ignition device having an insulator with a plasma cavity formed therein, a first electrode located at one end of said cavity, an orifice plate having a small orifice therein located at the other end of said cavity and means for forming an arc discharge between said electrode and orifice plate, the improvement comprising, a plurality of metallic electrodes spaced apart from each other by insulating material and located between said first electrode and said orifice plate thereby forming multiple spark gaps between said first electrode and said orifice plate.

8. In a plasma jet ignition device according to claim 7 wherein said plasma cavity is cylindrically shaped, said first electrode is located at one end of said cylinder and said orifice plate is located at said other end of said cylinder, the improvement according to claim 7 wherein each of said electrodes consists of a metallic ring and said electrodes are located in said cylindrical cavity towards said end closed by said orifice plate.

9. A plasma jet ignition device comprising:

an insulating material having a cylindrical cavity with an open end and a closed end therein;

a first electrode located at said closed end of said cavity;

an electrically conductive plate having a small orifice therein located at said open end and forming an enclosure with said cavity;

a cylindrical metal hydride ring located in said enclosure towards said closed end; and a plurality of cylindrical electrodes separated by cylindrical pieces of insulating material, said electrodes being located in said enclosure at said open end.

10. A plasma jet ignition device according to claim 9 wherein said metal hydride cylinder is formed of titanium hydride.

11. A plasma jet ignition device according to claim 9 wherein said metal hydride cylinder is formed of zirconium hydride.

12. A plasma jet ignition device according to claim 9 wherein each of said plurality of electrodes consists of a metallic ring.

13. A plasma jet ignition device according to claim 9 wherein at least one of said cylindrical pieces of insulating material is composed of an ablative insulating material.

14. A plasma jet ignition device according to claim 13 wherein at least one of said cylindrical pieces of insulating material is composed of magnesium oxide.

15. A plasma jet ignition device according to claim 13 wherein at least one of said cylindrical pieces of insulating material is composed of alumina.

* * * * *